US005927764A

United States Patent [19]

Harriman

[11] Patent Number: 5,927,764

[45] Date of Patent: Jul. 27, 1999

[54] SHOE LACE TIER

[76] Inventor: Gary V. Harriman, 5325 Lobo Dr., Indianapolis, Ind. 46327

[21] Appl. No.: 08/881,668

[22] Filed: Jun. 24, 1997

[51] Int. Cl.[6] ..... A47G 25/80; B65H 69/04

[52] U.S. Cl. ..... 289/17; 289/18.1; 223/113

[58] Field of Search ..... 223/111, 113, 223/DIG. 4; 289/17, 18.1; 36/1; 12/142 LC

[56] References Cited

U.S. PATENT DOCUMENTS

| | | | |
|---|---|---|---|
| 1,151,231 | 8/1915 | Young | 289/17 |
| 1,540,810 | 6/1925 | Simon | 223/113 |
| 2,899,226 | 8/1959 | Lint | 289/17 |
| 3,027,057 | 3/1962 | Johns | 223/113 |
| 3,149,384 | 9/1964 | Ryder | 223/113 |
| 3,197,097 | 7/1965 | Casner et al. | 223/113 |
| 3,771,699 | 11/1973 | Thibeault | 223/113 |
| 3,873,140 | 3/1975 | Bloch | 289/17 |
| 4,008,913 | 2/1977 | Cole | 289/17 |
| 4,815,772 | 3/1989 | Lizarraga | 289/17 |
| 5,316,189 | 5/1994 | Galeros et al. | 223/113 |

*Primary Examiner*—Michael A. Neas

*Attorney, Agent, or Firm*—Patent & Trademark Services; Joseph H. McGlynn

[57] ABSTRACT

A tool to assist in tying shoe laces, having a handle with three tool elements affixed at one end. One of the elements is a resilient element for holding a loop formed in the shoe lace, the second element is a holding element for holding the crossed laces and the third element is a hook for pulling one of the ends of the shoe lace through the loop.

3 Claims, 1 Drawing Sheet

SHOE LACE TIER

BACKGROUND OF THE INVENTION

This invention relates, in general, to a tool, and, in particular, to a tool which will facilitate tying shoe laces.

Description of the Prior Art

In the prior art various types of tools for tying various types of devices have been proposed. For example, U.S. Pat. No. 2,899,226 discloses a device used in the art of artificial fishing fly tying and more particularly to a hand tool for tying a whip finish knot with a hook and a spring holder at one end.

U.S. Pat. No. 4,008,913 discloses a tool for tying a whip finishing knot having a handle with a pair of hook elements at one end.

U.S. Pat. No. 4,815,772 discloses a tool for forming a knot in a man's necktie.

None of the prior art devices have dealt with the problems that small children or handicapped persons have in tying shoelaces. The present invention address and solves this very real everyday problem which must be faced by many people.

SUMMARY OF THE INVENTION

The present invention comprises a tool to assist in tying shoe laces, having a handle with three tool elements affixed at one end. One of the elements is a resilient element for holding a loop formed in the shoe lace, the second element is a holding element for holding the crossed laces and the third element is a hook for pulling one of the ends of the shoe lace through the loop.

It is an object of the present invention to provide a new and improved shoe lace tying tool.

It is an object of the present invention to provide a new and improved shoe lace tying tool which can be easily handled by young children or persons with physical handicaps.

These and other objects and advantages of the present invention will be fully apparent from the following description, when taken in connection with the annexed drawings.

DESCRIPTION OF THE PREFERRED EMBODIMENT

Figure 1:
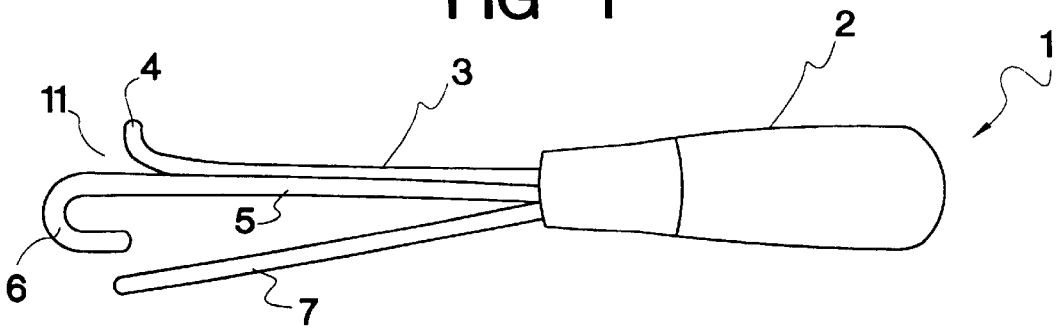
FIG. 1 is a plan view of the present invention.

Referring now to the drawings in greater detail, FIG. 1 shows the tool 1 of the present invention. It consists of a handle 2 which can be made from any rigid material such as, but not limited to, wood, plastic or metal. Attached at one end of the handle, by any conventional means, are three tool elements 3, 5, 7. Element 3 is a straight piece of resilient material which has a curved portion 4 (which curves away from element 5) at the end away from the handle 2. The curved portion along with the second element 5 forms a tapered lead in opening 11 for a purpose to be described later.

The second, or middle element 5 is a relatively rigid element which has a curved or hook shaped end 6, which is curved away from the element 3. The element 5 is substantially parallel to element 3 and is in contact with it throughout most of its length. The third element 7 is a relatively rigid element attached to the handle 2 and is disposed at an angle to the other elements 3, 5.

In order to use the tool 1 of the present invention, the user would first cross and knot the laces with a simple knot which is the normal first step in tying a bow. The laces are shown as conventional laces, however any type of laces, straps or strings could be tied using the disclosed tool. This is the first step which is normally taken when anyone ties a shoe lace. The shoe strings are left lying at opposite sides of the shoes at this point.

Also, the directions that follow are described for a person that is holding the tool in their left hand, which would be the affected hand. If the right hand is used, the user would substitute the right hand where the left hand is mentioned in the description.

Figure 2:
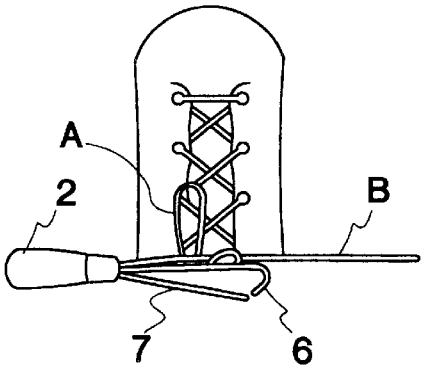
FIGS. 2–4 are views showing the various steps in utilizing the tool of the present invention.

The next step, shown in FIG. 2, is to form a loop A (approximately 1 inch in diameter) using the right hand. The loop should be close to the point where the laces are looped or crossed over each other. In addition the loop is formed on the left side of the shoe (as seen by the person wearing the shoe) with the free end of the other lace B extending toward the right side of the shoe.

Next, the tool 1 will be held in the user's left hand with the tool elements 3, 5, 7 perpendicular to the shoe. The loop A, formed in lace will now be slid into the tapered entrance 11, then in between the elements 3, 5. Since the element 3 is resilient it will flex away from element 5, thereby allowing the loop to be slid down until it is approximately at the midpoint of the tool. The resiliency of the element 3 will hold the loop without letting it slip.

Figure 3:
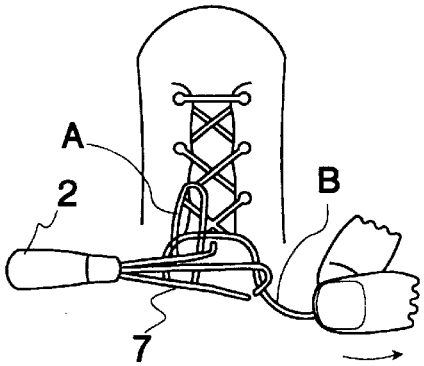
Figure 5:
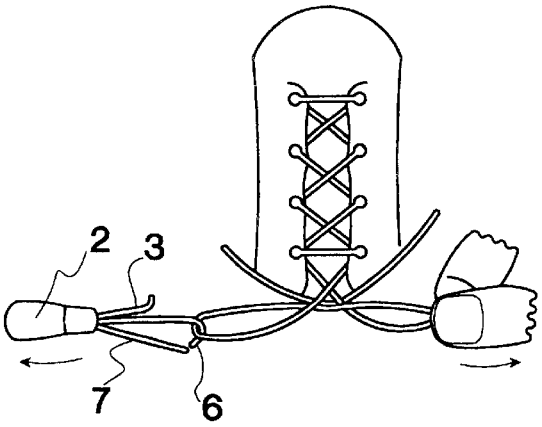

Next, the free end of the lace B is brought under the tool, passed over the tool and passed behind loop A (see FIG. 3) that is being held by resilient element 3 (see FIG. 5). This entire movement is made in a clockwise wrapping motion. The free end of the lace B is then hooked into hook or loop portion 6 of the center element 5.

While still holding the tool 1 and without moving it, the user will now pull the lace with the right hand slowly removing most of the slack.

Figure 4:
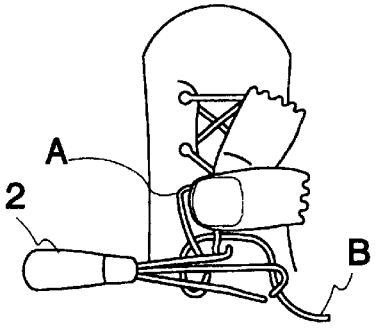

Next, the user will grasp the loop A (see FIG. 4) which is between the elements 3, 5 and hold it. In a quick, snapping motion, the user will pull the tool I directly to the left, as shown by the arrow in FIG. 5 while holding the loop stationary with their fingers. The curved or looped end 6 will pull the free end of the lace B through the loop between the elements 3, 5, thereby completing the bow.

Although the E-Z Tie and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. A tool to assist a person in tying shoe laces comprising:

a handle, said handle having three tool elements affixed to one end, a first of said three tool elements being resilient, and the other two of said three tool elements being relatively rigid, said first of said three tool elements having a curved end, said curved end extending in a first direction, a second of said three tool elements being substantially parallel to said first of said three tool elements, said second of said three tool elements having a curved end which extends in an opposite direction from said curved end on said first of said three tool elements, a third of said three tool elements being at an angle to said first and second of said three tool elements, said second of said three tool elements affixed to said handle at a position in between said first of said three tool elements and said third of said three tool elements.

2. The tool to assist a person in tying shoe laces as claimed in claim 1, wherein said first of said three tool elements has a curved end and is shorter than said second of said three tool elements, whereby a tapered inlet passage is formed between said first and second of said three tool elements.

3. The tool to assist a person in tying shoe laces as claimed in claim 1, wherein said second of said three tool elements has a curved end which is curved away from said first of said three tool elements.

* * * * *